US010941646B2

(12) United States Patent
Li et al.

(10) Patent No.: US 10,941,646 B2
(45) Date of Patent: Mar. 9, 2021

(54) FLOW REGIME IDENTIFICATION IN FORMATIONS USING PRESSURE DERIVATIVE ANALYSIS WITH OPTIMIZED WINDOW LENGTH

(71) Applicant: SCHLUMBERGER TECHNOLOGY CORPORATION, Sugar Land, TX (US)

(72) Inventors: Jiyao Li, Piermont, NY (US); Terizhandur S. Ramakrishnan, Boxborough, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 222 days.

(21) Appl. No.: 16/047,536

(22) Filed: Jul. 27, 2018

(65) Prior Publication Data

US 2019/0032474 A1 Jan. 31, 2019

Related U.S. Application Data

(60) Provisional application No. 62/538,001, filed on Jul. 28, 2017.

(51) Int. Cl.

| | |
|---|---|
| ***E21B 47/06*** | (2012.01) |
| ***E21B 49/00*** | (2006.01) |
| ***E21B 49/10*** | (2006.01) |

(52) U.S. Cl.

CPC ..... *E21B 47/06* (2013.01); *E21B 49/00* (2013.01); *E21B 49/10* (2013.01)

(58) Field of Classification Search

CPC ..... E21B 47/06; E21B 49/10; E21B 49/00

See application file for complete search history.

(56) References Cited

U.S. PATENT DOCUMENTS

| | | | |
|---|---|---|---|
| 4,860,581 | A | 8/1989 | Zimmerman et al. |
| 4,936,139 | A | 6/1990 | Zimmerman et al. |
| 6,230,557 | B1 | 5/2001 | Ciglenec et al. |
| 7,114,562 | B2 | 10/2006 | Fisseler et al. |
| 7,277,796 | B2 | 10/2007 | Kuchuk et al. |

(Continued)

OTHER PUBLICATIONS

Bourdet, D. et al., "Use of Pressure Derivative in Well-Test Interpretation", SPE Formation Engineering, 1989, 4(2), pp. 293-302.

(Continued)

*Primary Examiner* — Mohammad K Islam

(74) *Attorney, Agent, or Firm* — Trevor G. Grove

(57) ABSTRACT

A method of investigating an earth formation. A tool having a pressure sensor is used in a borehole to collect formation fluid pressure data over time. A pressure derivative curve is generated from the formation fluid pressure data by conducting a piecewise linear regression of the data having optimal window length values L determined by calculating a derivative with respect to L of a pressure derivative value (DD), and selecting values of L where DD has a transition that departs from oscillatory behavior to gradual change. The pressure derivative is calculated with piecewise linear regression with the optimal window length values 2L. Different L values are generated for different groups of data points obtained over time. The pressure derivative is then used for flow regime determination.

18 Claims, 14 Drawing Sheets

(56) References Cited

U.S. PATENT DOCUMENTS

| | | | | |
|---|---|---|---|---|
| 7,594,541 | B2 * | 9/2009 | Ciglenec | E21B 49/10 166/105 |
| 7,748,450 | B2 * | 7/2010 | Mundell | E21B 43/12 166/250.15 |
| 8,918,288 | B2 * | 12/2014 | Chok | E21B 47/12 702/12 |
| 9,429,010 | B2 * | 8/2016 | Winters | E21B 47/001 |
| 9,988,895 | B2 * | 6/2018 | Roussel | E21B 43/26 |
| 10,208,585 | B2 * | 2/2019 | Surowinski | G01O 5/06 |
| 10,215,010 | B1 * | 2/2019 | Hadi | G05B 19/416 |
| 10,570,733 | B2 * | 2/2020 | DiFoggio | E21B 49/08 |
| 10,648,321 | B2 * | 5/2020 | Hadi | E21B 44/04 |

OTHER PUBLICATIONS

Bourdet, D. et al., "A new set of type curves simplifies well test analysis", World Oil, 1983, 196, pp. 95-106.

* cited by examiner

FLOW REGIME IDENTIFICATION IN FORMATIONS USING PRESSURE DERIVATIVE ANALYSIS WITH OPTIMIZED WINDOW LENGTH

RELATED APPLICATIONS

This application claims priority from U.S. Application Ser. No. 62/538,001, entitled "Optimal pressure derivation", filed on Jul. 28, 2017, which is hereby incorporated by reference herein in its entirety.

FIELD OF THE DISCLOSURE

The subject disclosure relates to formation evaluation. More particularly, the subject disclosure relates to flow regime identification in formations using pressure data.

BACKGROUND

Plots of derivatives of pressure transients obtained by a borehole tool which is in fluid communication with a formation are widely used for flow regime identification. See, e.g., co-owned U.S. Pat. No. 7,277,796 to Kuchuk et al. which is hereby incorporated by reference in its entirety. See, also "Fundamentals of Formation Testing" (2006), published by Schlumberger. The plots may also be used for diagnosing boundary effects and storage and possibly other anomalies. See, "Fundamentals of Formation Testing" (2006), published by Schlumberger. Excessive noise in the calculated pressure derivative may lead to uncertain or even wrong diagnosis of the reservoir geometry; i.e., an incorrect system identification. Smoothing algorithms that have been proposed to calculate pressure derivative with noisy data are currently unsatisfactory.

Numerical derivative calculations using forward, backward or central difference methods work well for mostly noise-free data with equally spaced x values. For example, the central difference method is $$\frac{dy}{dx} = \frac{y_{x+x} - y_{x-x}}{2x} \tag{1}$$

However, pressure derivative calculations with field pressure data are challenging, for two reasons. First, measured formation pressure data from the field are noise contaminated; and second recorded pressure data are usually spaced uniformly in time (spacing is t). But the independent variable x in the pressure derivative calculation for flow regime identification is ln(t) or log(t). Data are therefore very sparse at the beginning of a test, and dense at a later stage. Any small noise in the pressure data will be greatly magnified if the derivative calculation uses neighboring data points with forward, backward or central difference methods.

Because of the problems with the use of the forward, backward and central difference methods for noisy data, a differentiation algorithm proposed by Bourdet is widely used for pressure derivative calculation with field data. See, Bourdet, D. et al., "Use of pressure derivative in well test interpretation," SPEFE 4(2), pp. 293-302 (1989), and Bourdet, D. et al., "A new set of type curves simplifies well test analysis," *World Oil,* 196, pp. 95-106 (1983). In the Bourdet differentiation algorithm, the pressure derivative is computed using a three-point central difference formula given by $$\left(\frac{dP}{dX}\right)_i = \left(\frac{P_{i+j} - P_i}{X_{i+j} - X_i}\right)\left(\frac{X_i - X_{i-k}}{X_{i+j} - X_{i-k}}\right) + \left(\frac{P_i - P_{i-K}}{X_i - X_{i-k}}\right)\left(\frac{X_{i+j} - X_i}{X_{i+j} - X_{i-k}}\right) \tag{2}$$

where P is pressure, X is the time function (e.g., spherical-superposition time or radial-superposition time), and the subscript i is the target location or point location for derivative calculation. Choosing j and k to be unity is as simple as using neighboring consecutive points. In practice, when this algorithm is applied to field pressure data, j and k are chosen such that $X_{i+j}\ X_i \approx X_i\ X_{i\ k} \approx L$, with L being referred to as the differentiation interval or smoothing interval. In practice, the minimum number of data points for a derivative calculation is usually set to be three (two if the desired point is at the edge). If the provided L value is smaller than that of the neighboring points, the actual smoothing window length will be automatically adjusted to the data spacing. When L is too small, the derivative will be dominated by noise, because the fluctuations become comparable or overwhelm the data trend. Too large an L causes the derivative curve to be distorted by the overall trend of the data as opposed to the local value.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Methods and systems obtain pressure data from a formation-fluid-sampling borehole tool and use pressure derivative calculations that suppress noice while maintaining accuracy for purposes of improvement in flow regime identification.

In embodiments, a formation-fluid-sampling borehole tool with one or more pressure sensors is used to provide data points for pressure buildup detected by the borehole tool, and the derivative of a pressure derivative with respect to a desired/optimal window length L is obtained. The desired/optimal window length for different points in time is determined in embodiments by taking the absolute value of the derivative of the pressure derivative with respect to L, taking the integral of the absolute value of that derivative, fitting an approximant such as a Padé-approximant to the resulting integral curve, and selecting the window length value L based on a selected slope value of the fit curve. Once L is determined, the pressure derivative is calculated with piecewise linear regression of data points within twice the optimal window length. Different L values are generated for different groups of data points obtained over time.

BRIEF DESCRIPTION OF DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the examples of the subject disclosure only and are presented in the cause of providing what is believed to be the most useful and readily understood description of the principles and conceptual aspects of the subject disclosure. In this regard, no attempt is made to show structural details in more detail than is necessary, the description taken with the drawings making apparent to those skilled in the art how the several forms of the subject disclosure may be embodied in practice. Furthermore, like reference numbers and designations in the various drawings indicate like elements.

Figure 1:
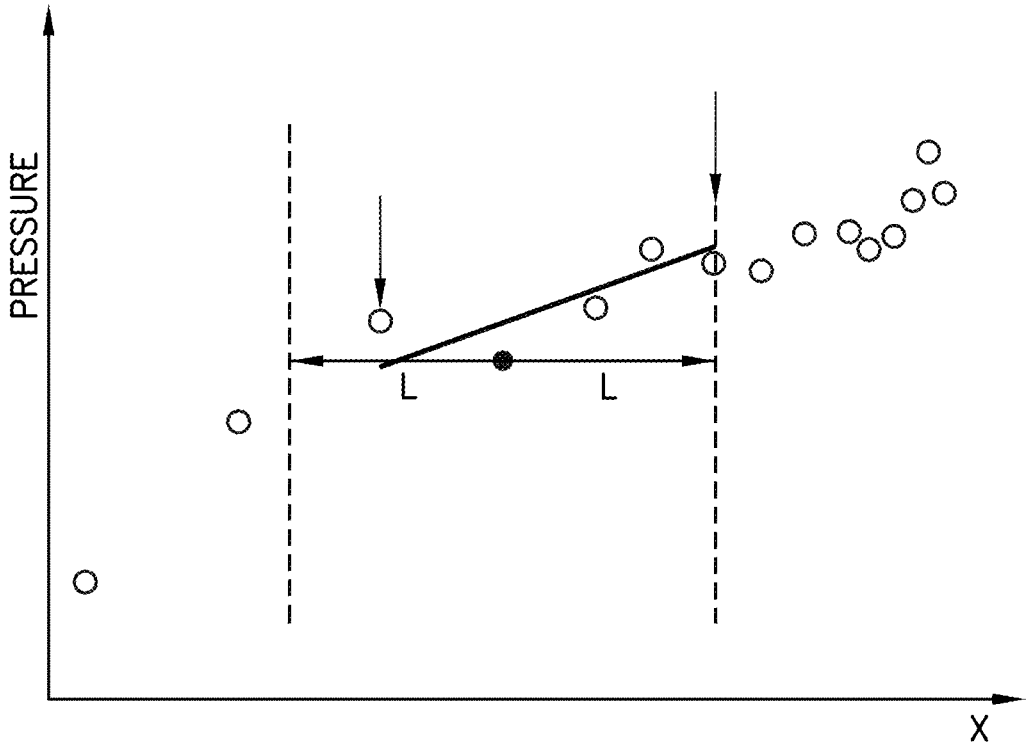
FIG. 1 is a plot showing application of a three-point difference method and piecewise linear regression with a smoothing interval L.

As previously described, Bourdet's three-point difference algorithm only uses three data points to calculate the pressure derivative. This is seen in FIG. 1 where data points are indicated, the circle is the target location for the derivative calculation, and the arrows point to the edge data points that are to be used for a three-point difference method. Using the three-point difference algorithm, the derivative calculation can still be easily affected by the noise. In practice, L needs to be set large in order to get a derivative curve that is not dominated by noise.

According to one aspect, the three-point difference algorithm may be improved upon by conducting a piecewise linear regression rather than just choosing three data points in the middle and on the edges, within the same window, i.e., window length of 2L centered at the circled target location as shown in FIG. 1.

The equation for piecewise linear regression is $$P_i = b_0 + b_1 X_i \tag{3}$$

where the subscript i is the target location for a derivative calculation. The pressure derivative is the slope of the best-fitting linear line and can be calculated from $$b_1 = \frac{\sum (X_m - \overline{X})(P_m - \overline{P})}{\sum (X_m - \overline{X})^2} \tag{4}$$

where subscript m means the data points within the 2L window, and $\overline{X}$ and $\overline{P}$ are the averaged value of X and P within the window. In FIG. 1, the angled line is the linear regression using the data points within the smoothing window of length 2L.

Both the Bourdet's three-point difference algorithm and the piecewise linear fitting require the parameter of window length, L, as an input. As stated before, it is desirable to set a proper smoothing window length. According to embodiments, methods for determining an improved window length parameter, i.e., a desirable or optimal L, are provided. Since a piecewise linear regression generally provides better results than Bourdet's three-point difference algorithm, according to embodiments, methods of selecting an optimal L for pressure derivative calculation are utilized in conjunction with a piecewise linear regression.

Figure 2:
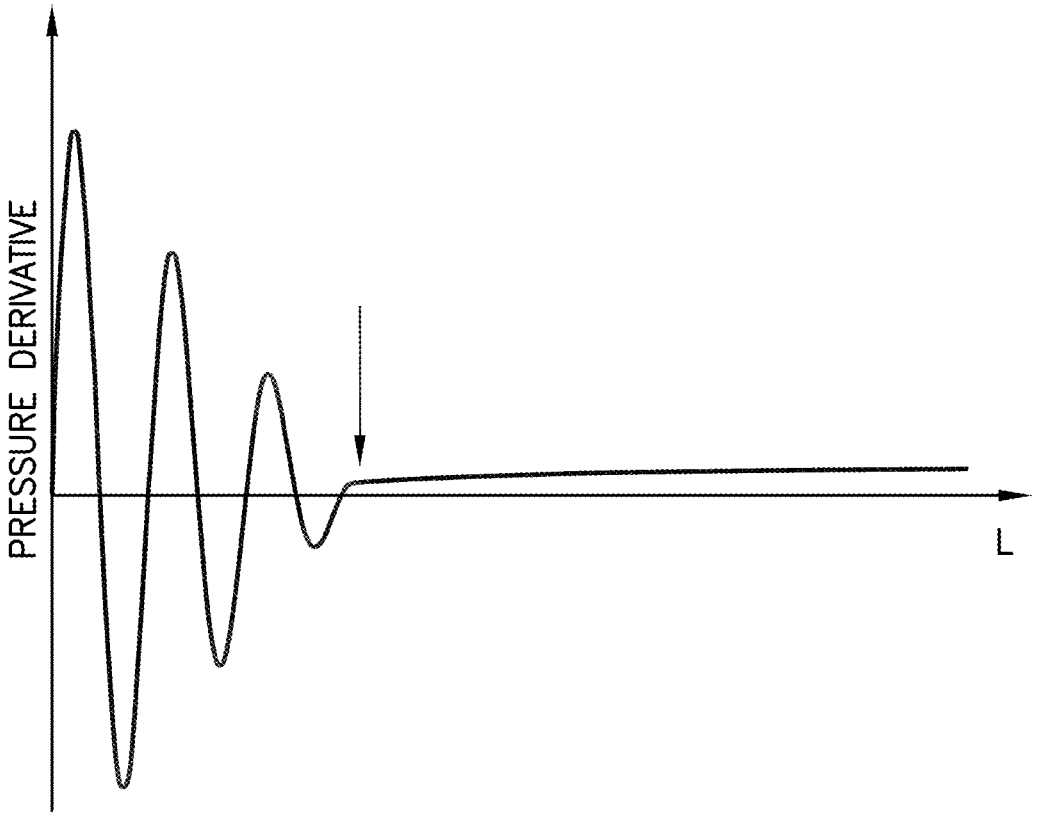
FIG. 2 is a diagram showing pressure derivative values calculated using different L values at a specific target location.

As illustrated in FIG. 2, pressure derivative calculations at a specific data point will be different when using different L values. When L is small, the pressure derivative value oscillates as L increases, and is driven by noise comparable or even larger than signal change over the interval. As L increases further, the derivative value will be relatively stable. But a derivative calculated using too large a window will not reflect the true measure at the target data point because it no longer reflects a local value. Thus, according to one aspect, a desirable L value will be at or near the transition point or location where the pressure derivative stabilizes while being unaffected by the signal trend (too much smoothing).

Figure 3:
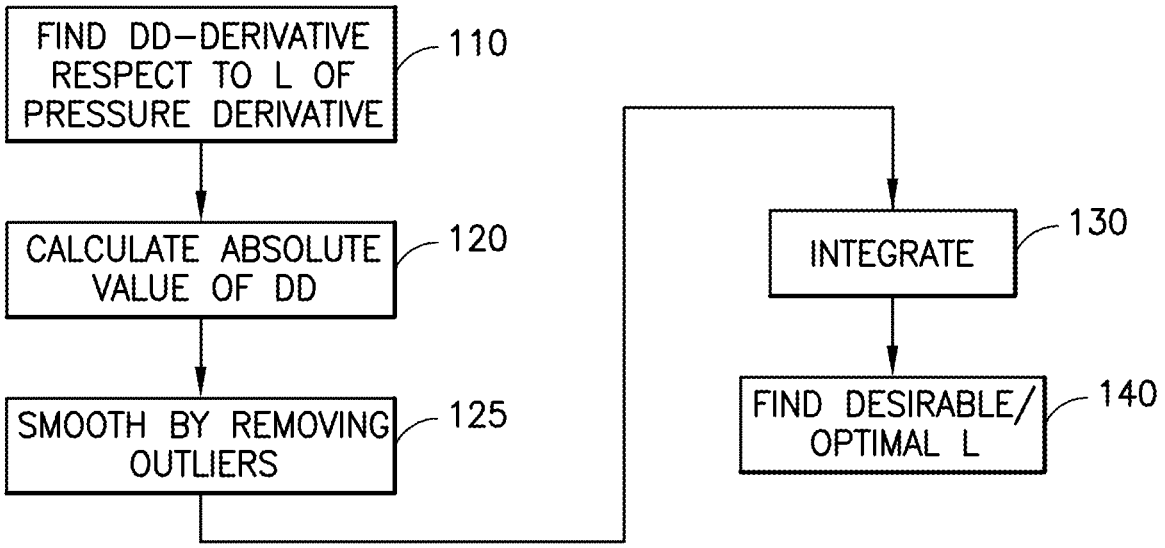
FIG. 3 is a block diagram of a method for finding a desirable L value.
Figure 4:
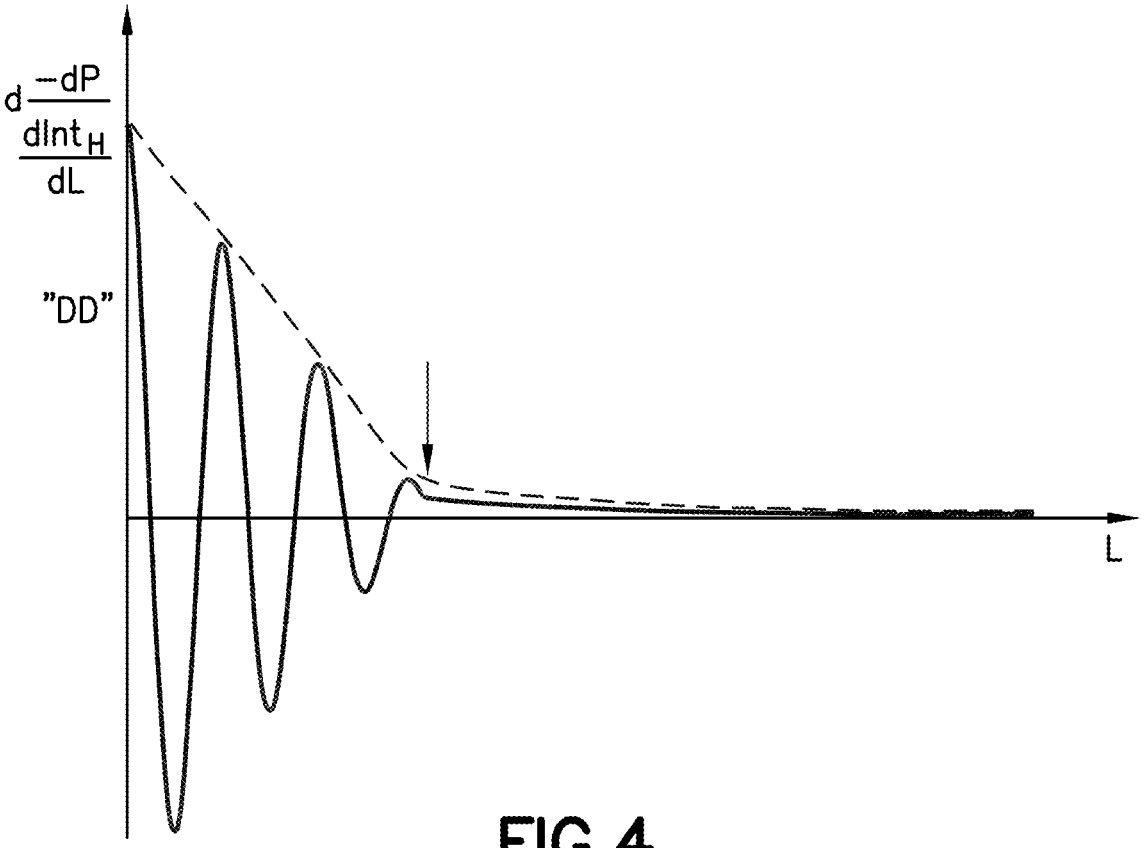
FIG. 4 is a diagram showing the derivative of a pressure derivative with respect to different L values.

According to one embodiment, and as shown in FIG. 3, in order to obtain a desirable value of L, as a first step 110, the derivative of the pressure derivative with respect to L, $$\frac{d\frac{dP}{dX}}{dL},$$

hereinafter referred to as DD is determined. Theoretically, when the pressure derivative value departs from its oscillatory behavior to a gradual change due to over-smoothing, DD will also change from sharp variations to a near constant value as shown in FIG. 4. Conversely, as L decreases, the location where the DD deviates from nearly stable plateau will be the desirable L.

In some embodiments, a threshold of percentage change can be set and the DD value as L decreases can be tracked, and a desirable L may be chosen based on where the DD deviation exceeds a threshold.

In other embodiments, because field data may have very different shapes of DD curves at different target data points, the threshold of percentage change is not utilized. Rather, as shown in FIG. 3, the absolute value of DD may be taken at 120. Just as with the original DD, the absolute value of the DD will have large oscillations at the beginning and shift to a much smaller stable value. As discussed hereinafter, the absolute values of the DD are optionally smoothed or trimmed for outliers at 125. Then, at 130, the (optionally smoothed) absolute value of DD is integrated according to $\int_{L_{min}}^{L_{max}}|DD(L)|dL$. A desirable L may then be determined at 140 by min finding a transition point where the integration value changes slope from a large value to that of the long time trend of the signal.

In one embodiment, the transition point on the integrated curve can be determined by measuring the slope of the curve. However, since the integration is monotonically increasing and smooth, and passes from one slope to another and is convex, according to another embodiment, a fit can be implemented and then the slope at any location may be analytically estimated.

In one embodiment, a Padé fit may be utilized so that the slope may be analytically estimated at any location. The Padé approximant of order {m,n} for any function $f(x)$ is $$R(x) = \frac{\sum_{j=0}^{m} a_j x^j}{1 + \sum_{k=0}^{m} b_k x^k} \tag{5}$$

In one embodiment, a Padé approximant of order {1,1} may be used to fit the integrated curve. This approximant is strictly convex or concave for interval, $0 \le x < +\infty$, depending on the specific value of the coefficients, $a_0$, $a_1$, $b_1$. Because the fitted curve is expected to be monotonically increasing and smooth, and convex, prior to integration, as previously mentioned, the absolute value DD may be smoothed and trimmed to remove extremely large values (i.e., outliers) so that the integral will be smooth and not strongly affected by extremes.

Figure 5A:
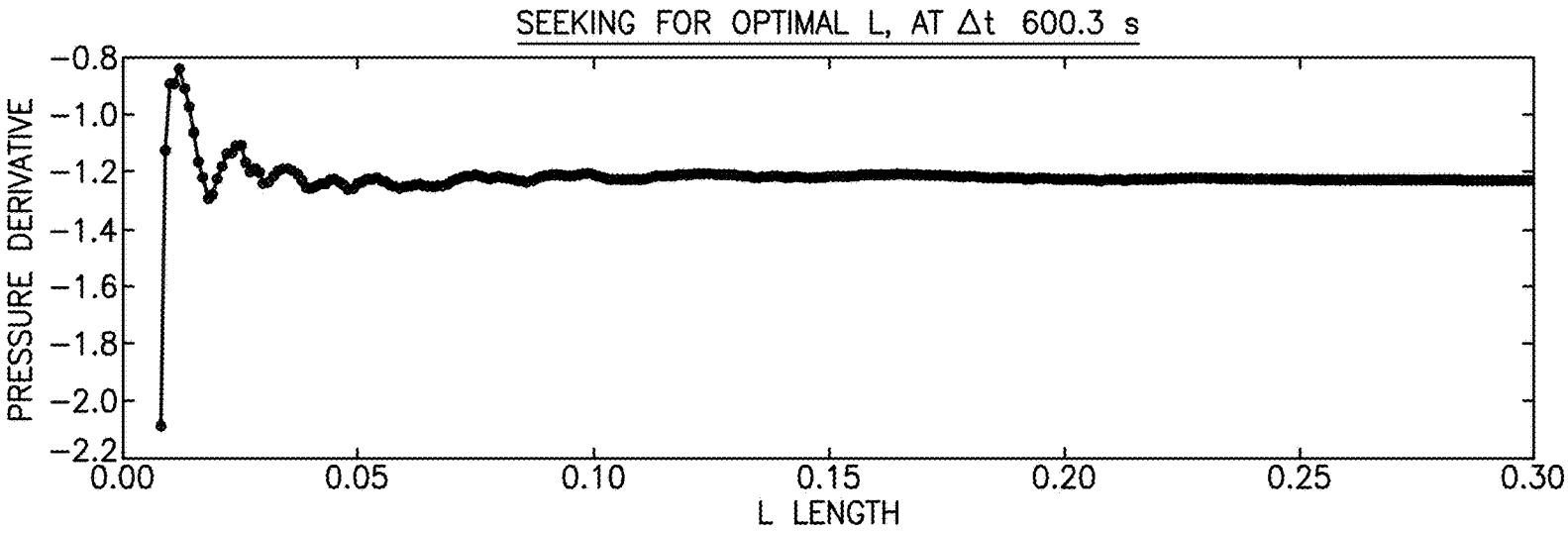
FIG. 5*a* is a plot showing the pressure derivative calculated using a range of different L values.
Figure 5B:
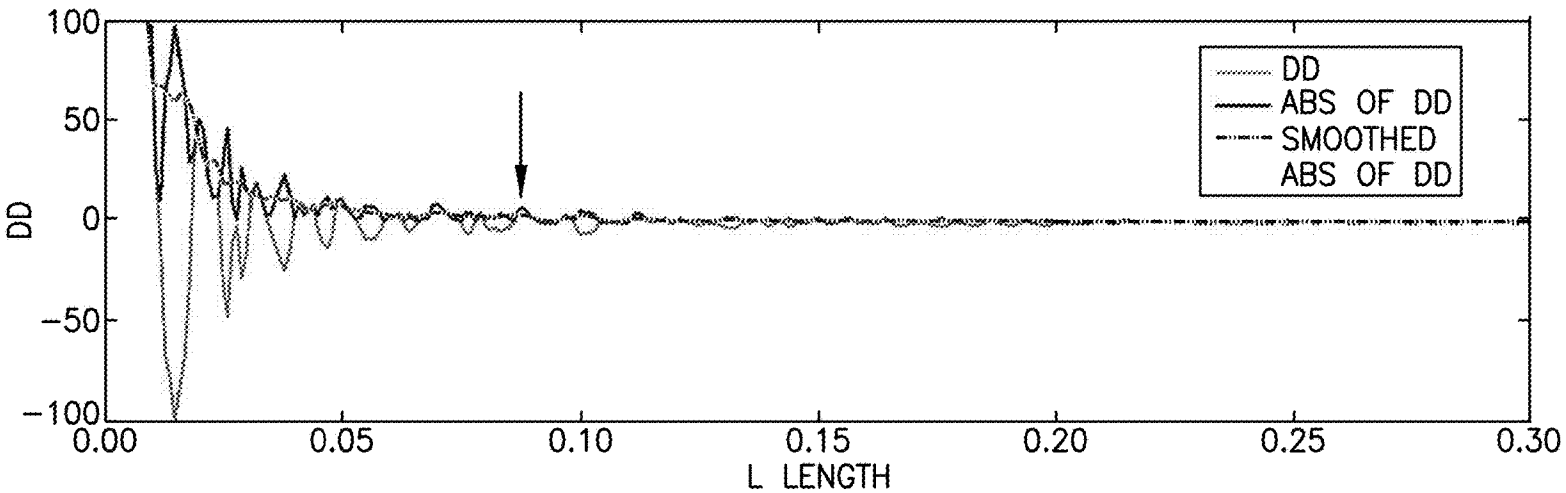
FIG. 5*b* shows the calculated derivative of the pressure derivative, its absolute value and the smoothed curve.
Figure 5C:
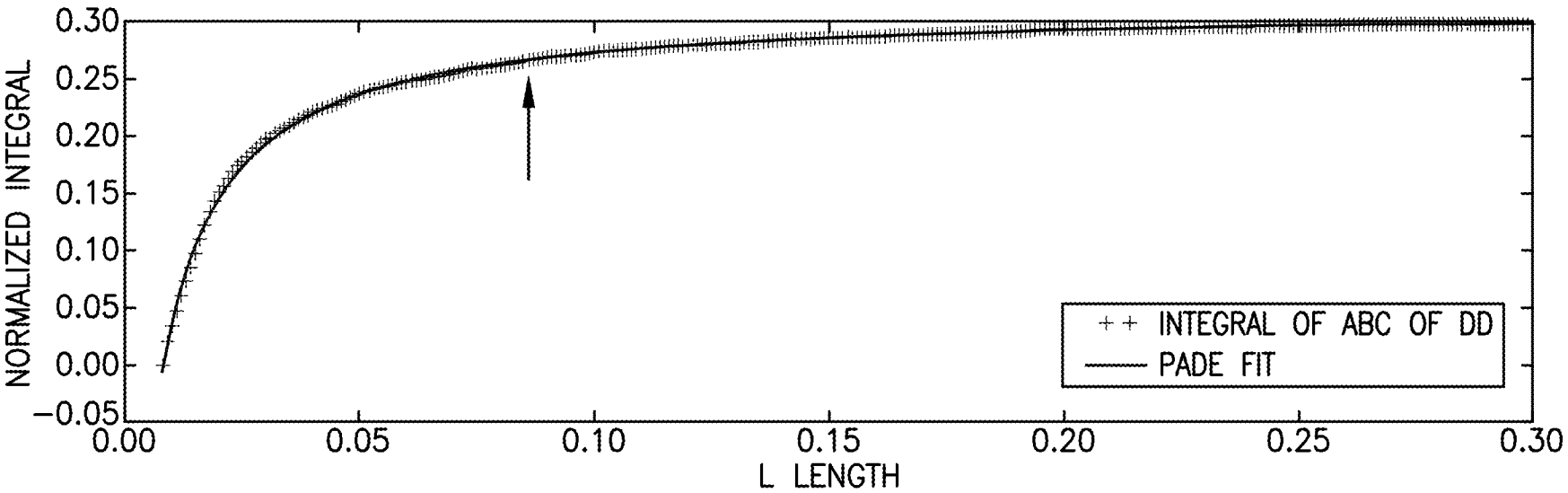
FIG. 5*c* shows the normalized integral of the smoothed absolute derivative of the pressure derivative, the best-fitting Padé approximant curve, and a determined location for an optimal L value.

Methods for determining a desirable L value for field data are seen with reference to FIGS. 5*a*-5*c*. The pressure derivative is calculated for a specific data point in the late-time period of the build-up (600.3 seconds), where the pressure is nearly stable but is noisy. For a simple pressure build-up, i.e. assuming constant flow rate which stops at time $t_p$, the pressure derivative is calculated as $$\frac{dP}{d\ln t_H} = \frac{dP}{d\ln t}\left(\frac{t_p + t}{t_p}\right) \tag{6}$$

where $t_p$ is the flowing time for flow, t is the elapsed time since flow cessation, and $t_H$ is the Horner time, $$t_H = \frac{t_p + t}{t}.$$

FIG. 5*a* shows the pressure derivative calculation using different L values ranging from 0 to 0.3, with 0.001 spacing. FIG. 5*b* shows DD (i.e., the derivative with respect to L of the pressure derivative), the absolute value of DD, and the smoothed absolute value of DD obtained by trimming the extremes of absolute value of DD to the upper limit value of 100 and smoothing using a running window average of seven neighboring points. FIG. 5*c* shows the integral of the smoothed absolute value of DD. The integral is shown increasing sharply in the beginning, with an L between 0 and about 0.025, with a more gradual subsequent increase. The integral is normalized so that the horizontal scale and vertical scale are the same, since it is the transition point that is of interest rather than the specific value of the integral. A best-fitting approximant to the integral may be calculated by a least-square optimization. In one embodiment, a desirable L is picked in a location where the slope of the fit curve equals 0.5. In FIG. 5*c*, the L value where the slope of the normalized fit curve equals 0.5 is about 0.07-0.08.

In some embodiments the transition region of the integral of the absolute value of DD is sufficiently wide such that selecting a desirable L at where the slope of the fit curve is in a range will affect the outcome only marginally. Thus, by way of example, the L value may be chosen where the slope of the fit curve to the normalized integral is between 0.25 and 0.75.

Once an L value is selected for a point, the pressure derivative for that point can be calculated with piecewise linear regression with a window length of 2L according to equations (3) and (4). As pressure derivatives for multiple points are calculated (with their own window lengths), a plot of the derivative of the pressure transient can be generated. The plot of the derivative of the pressure transient is then used for flow regime identification.

In the following two examples, pressure derivative curves are derived from field pressure build up data utilizing desirable or optimal window length Ls as generated according to the previously described methods (i.e., integrating a smoothed absolute value of the derivative with respect to L of the pressure derivative; fitting a curve to the integral; and finding the L value where the slope of the fit curve equals a determined value such as 0.5). In one example, the pressure buildup data is obtained over 3000 seconds. In the other example, the pressure buildup data is obtained over 12000 seconds. The derivative calculated is dP/dln Δt. Pressure data recorded in the field is usually equally spaced in time domain, t; e.g., one measurement every second. So in the ln Δt domain, the pressure data is very sparse in the beginning and becomes denser at a later stage. For the very sparse beginning time stage, it may be meaningless to determine the optimal L according to the previously described methods since the minimum number of data points for an effective derivative calculation is at least three (two if at the edge) and the data spacing would already be very large. Accordingly, in one embodiment, the method for determining the desirable L starts some time, e.g., thirty seconds, after the build-up initiation. For the data obtained before thirty seconds, a constant L of, e.g., 0.1 is selected. Since the data at the beginning of the field pressure build up test (i.e., "early data points") are sparse, and the signal changes significantly, the derivative calculation is not sensitive to noise in that time period. In one embodiment, the optimal L calculation may be carried out for a desired number of data points in each log cycle of log Δt (e.g., the cycle from $10^1$ to $10^2$, from $10^2$ to $10^3$, from $10^3$ to $10^4$). By way of example only, twenty data points may be selected for an optimal L calculation for each log cycle. In one embodiment, the selected data points may be evenly spaced in the log Δt domain. Regardless, once an optimal L is determined for a given point, the pressure derivative for that point can be calculated using a linear regression with a window length of 2L.

In both the tested field examples discussed below, the calculated optimal L and the pressure derivative curve calculated using the optimal window length at each data point are shown. For purposes of comparison, a pressure derivative curve calculated using different constant L values is also shown.

Figure 6:
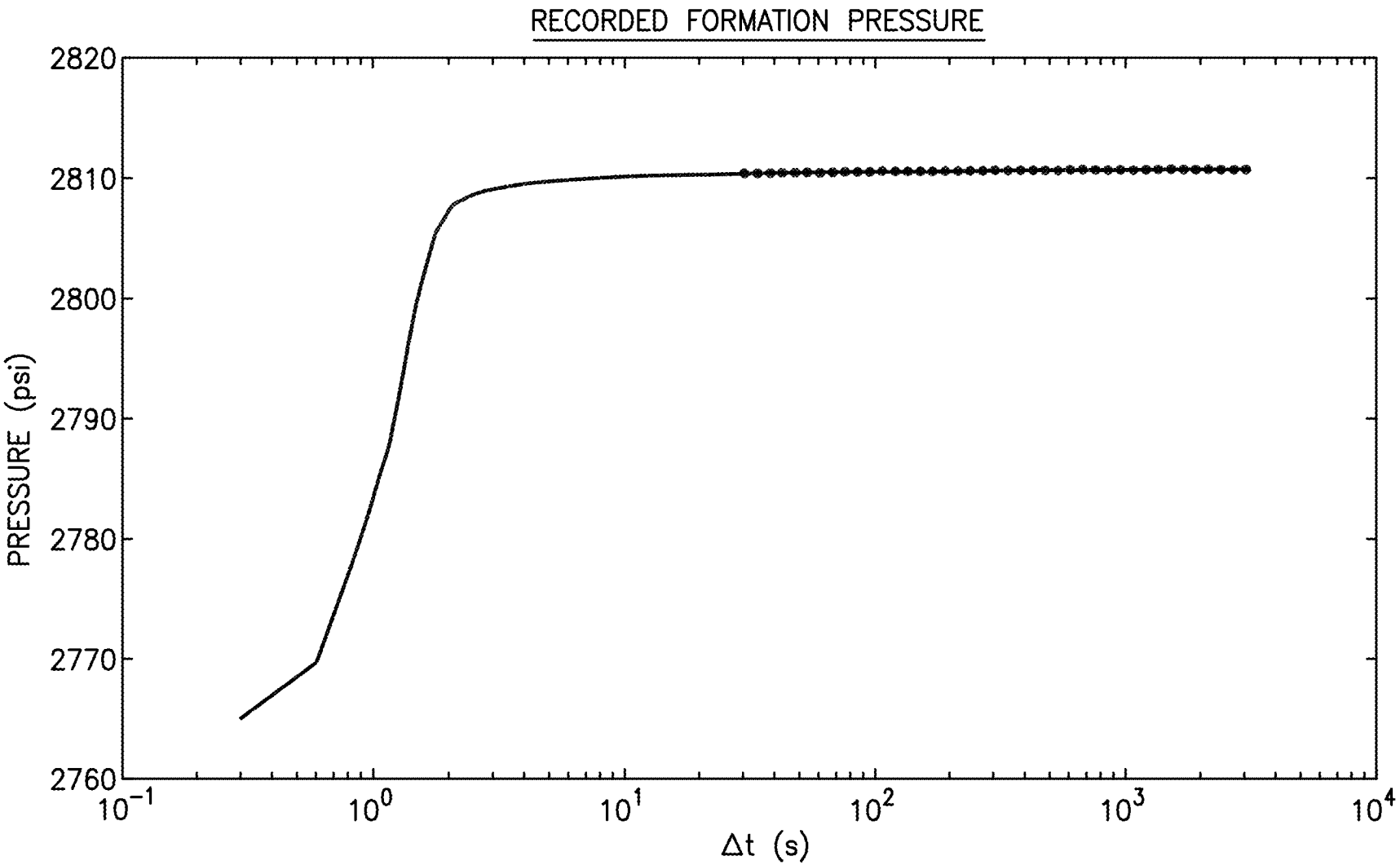
FIG. 6 is a plot of pressure build up data for a field example.

In the first field example shown in FIG. 6, the pressure quickly increased over 40 psi within the first few seconds. From 100 seconds after build-up onset to the end of the recorded build-up at approximately 3000 seconds, the pressure is seen to be substantially stable with less than a 0.2 psi total increase. In this later stage, since pressure increase from buildup is minimal, random noise is evident, and has an amplitude of approximately 0.004 psi. However, this very low amplitude noise is enough to create overwhelming noise in the pressure derivative, especially if adjacent points or a short window is used for calculating the derivative.

Figure 7A:
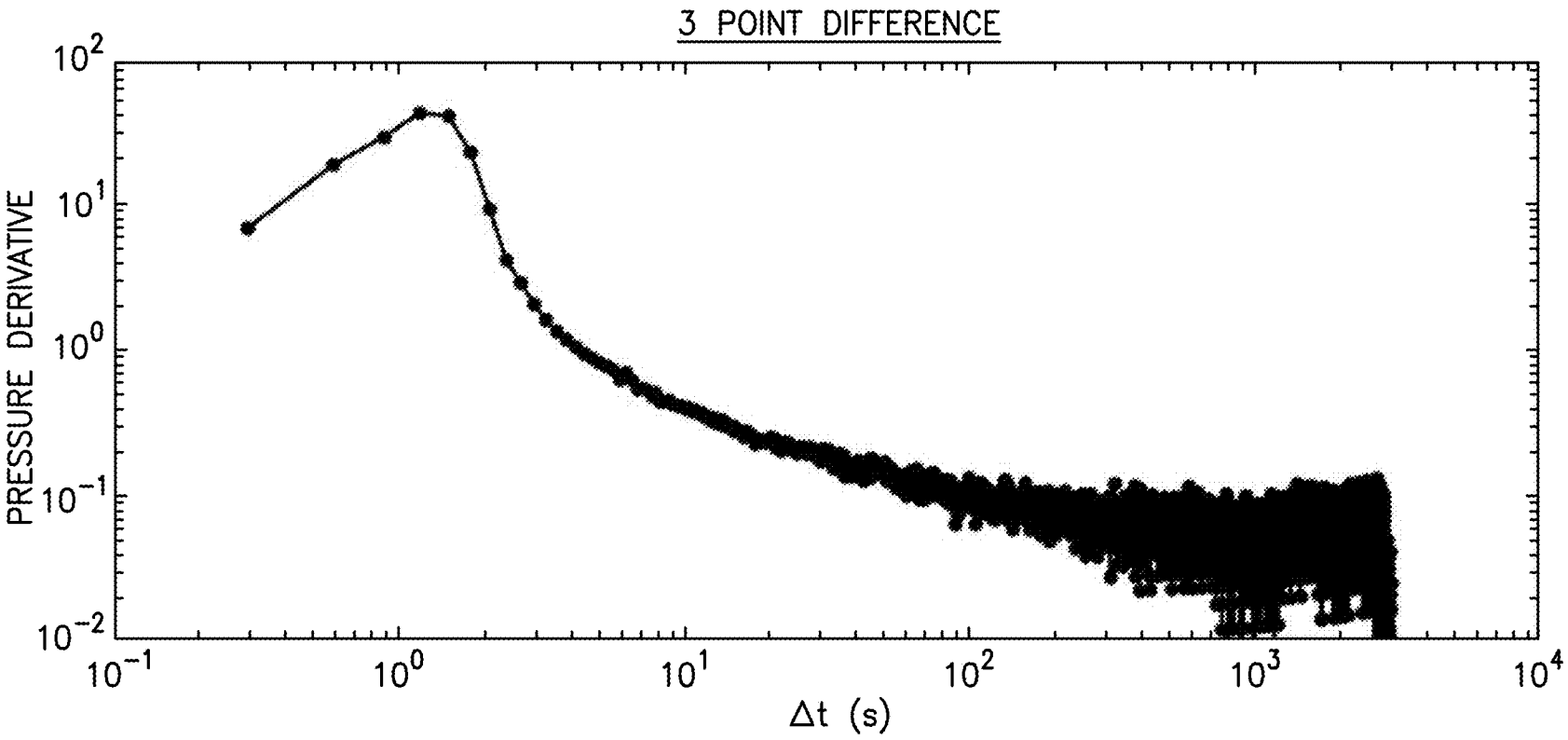
FIG. 7*a* is a plot showing pressure derivative information calculated using Bourdet's three-point difference method.
Figure 7B:
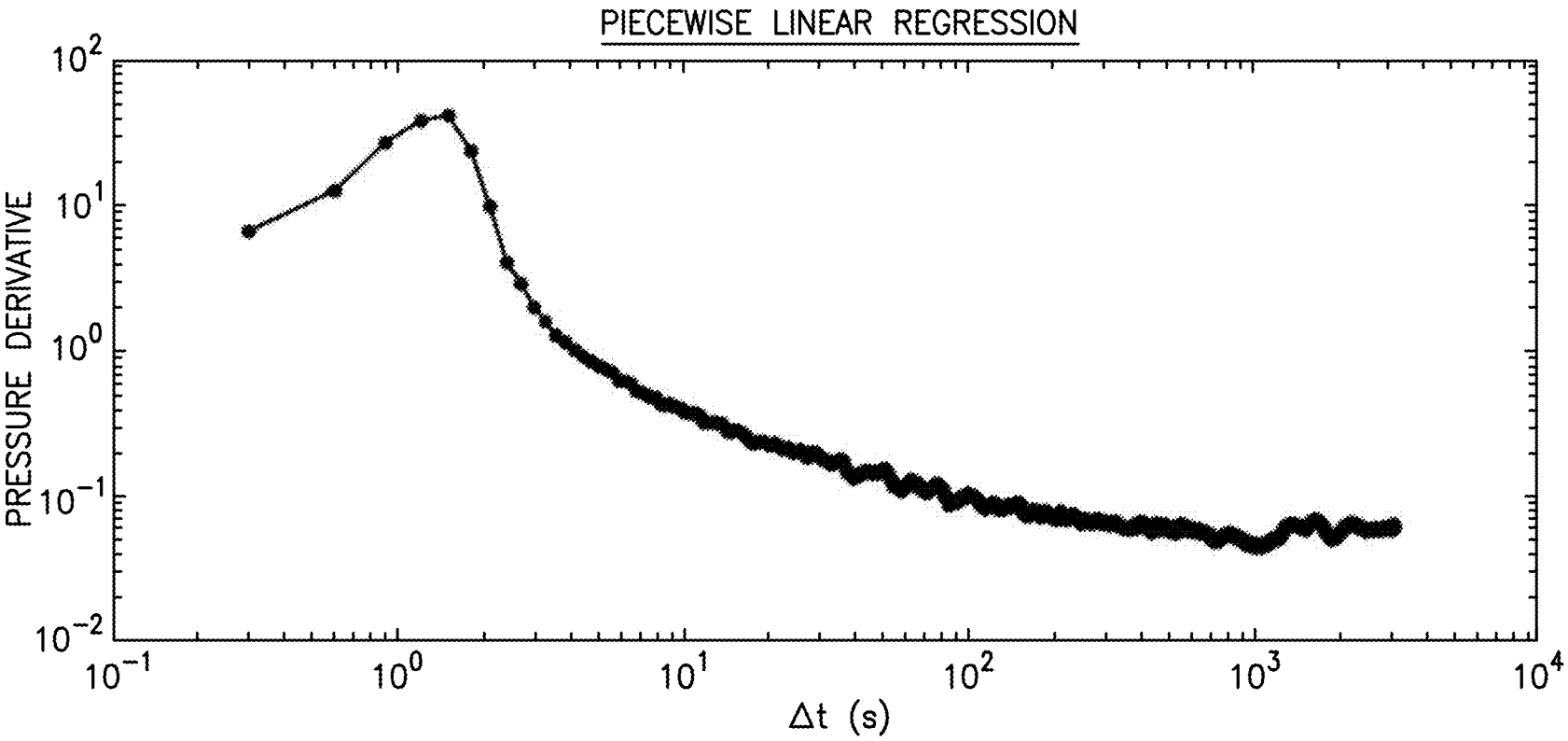
FIG. 7*b* is a plot showing pressure derivative information calculated using a piecewise linear regression method.

FIGS. 7*a* and 7*b* show the pressure derivative curve calculated using Bourdet's three-point difference method, and the piecewise linear fitting respectively. In both calculations, the L value is set to be 0.1 of a log cycle (such that the actual window would be 0.2 of a log cycle). It is clear that the piecewise linear regression has the advantage over three-point difference method for suppressing noise. At a later stage, e.g. t=1000 seconds, the noise level on the pressure derivative calculated using the three-point difference method and the piecewise linear regression are 1 and 0.1 log cycles respectively. By applying a longer smoothing window, i.e. larger L, the noise level is suppressed even more, using either method. However, as discussed previously, too much smoothing will distort the derivative curve. At different time locations of the curve, the required optimal smoothing level could be different.

Figure 8:
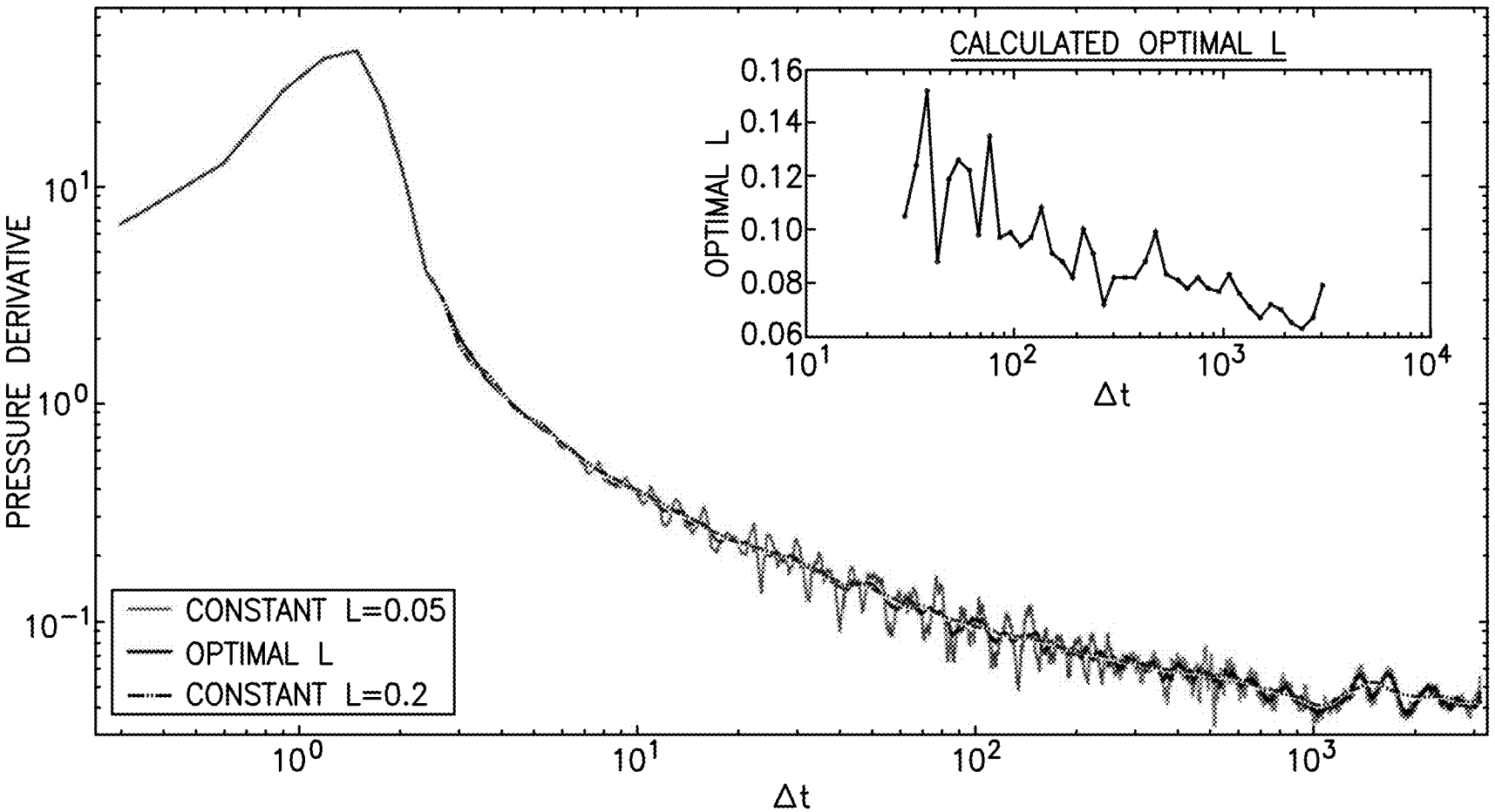
FIG. 8 is a plot of a pressure derivative curve using optimal L values versus pressure derivative curves using fixed L values for a set of data, and with calculated optimal L values at different times being show in the plot insert.

A desirable or optimal L calculated utilizing the previously-described methods is shown in the insert box of FIG. 8. The optimal L value starts at around 0.12 and generally declines to 0.06 at a later time. The pressure derivative curve calculated using the optimal L values for piecewise linear regression are also shown in FIG. 8. For comparison purposes, derivative curves using constant L values of 0.05 and 0.2 are also plotted in FIG. 8. As can be appreciated, the derivative curve using a constant L value of 0.05 contains too much noise, especially in the early stage, whereas the derivative curve generated by using a constant L of 0.2 results in excessive smoothing especially in late stages.

Figure 9:
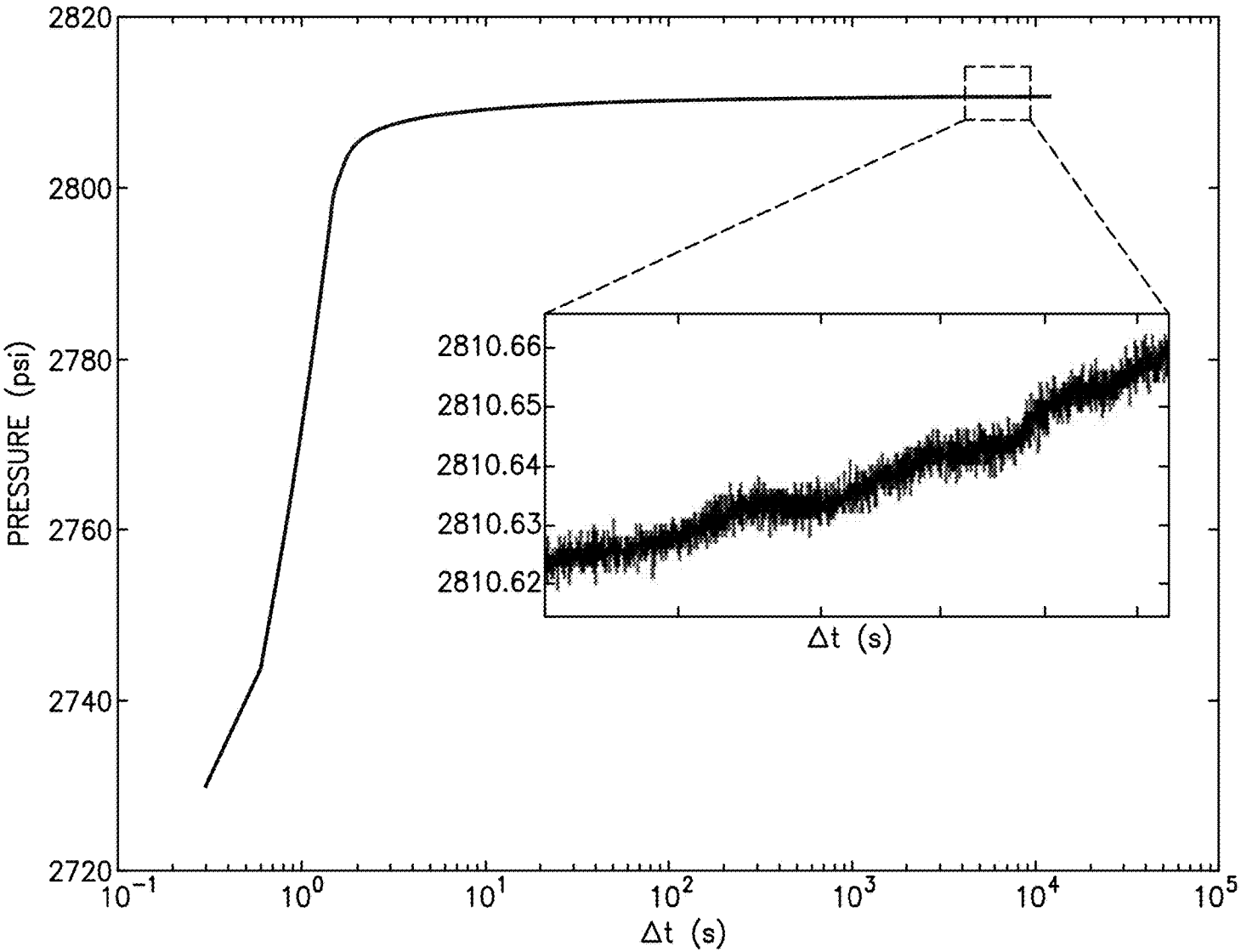
FIG. 9 is a plot of pressure build-up data of another field example, with the plot insert showing oscillation in the log Δt domain at the indicated timeframe of the plot.

Turning now to FIG. 9, in another field example, the pressure is seen to quickly increase over 80 psi within the first few seconds and then to quickly stabilize. The pressure build up dataset for this example has similar characteristics to the dataset of FIG. 6 in terms of both pressure response signal and random noise due to insufficient resolution.

Figure 10:
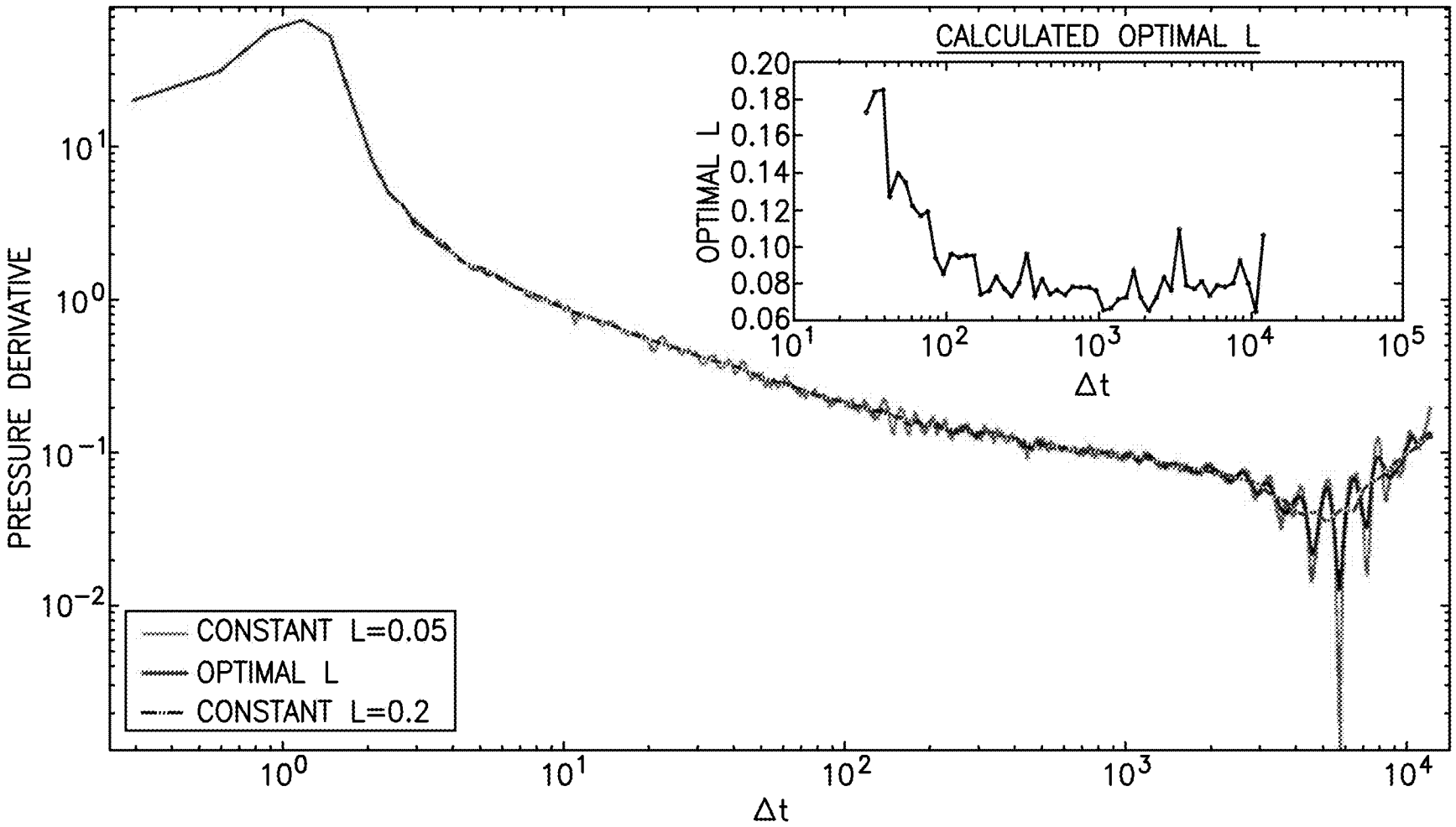
FIG. 10 is a plot of a pressure derivative curve using optimal L values versus pressure derivative curves using piecewise linear regression with two different constant L values for the set of data of FIG. 9, and with calculated optimal L values at different times being show in the plot insert.

Using the methods previously described, the optimal L was calculated for various points and plotted. As seen in the inset of FIG. 10, the optimal L value determined by the previously described methods starts at about 0.18 and then decreases to 0.07 over the period from about 40 s to 200 s. Then the optimal L value is relatively stable around 0.07, although a few calculations are shown to provide values at almost as low as 0.06 and as high as 0.11. In theory, the optimal L calculated gives just enough smoothing to suppress the noise while not distorting the derivative. This theory is borne out by the results shown in FIG. 10. In particular, in FIG. 10, it is seen that the noise level on the derivative curve using the optimal L values is low before approximately 3000 seconds. Thereafter, the pressure derivative curve oscillates with a period of about 0.1 log cycle. An examination of the pressure build-up data at the same time range clearly reveals oscillation with a similar period (although the source of this oscillation is unclear). By plotting the pressure derivative using constant L values of 0.05 and 0.2 in FIG. 10 for comparison purposes with the pressure derivative obtained using the optimal L values, it is seen that while the oscillation signal is preserved in the derivative curve calculated using the obtained optimal L values, it is not found in the pressure derivative curve obtained using an L value of 0.2 which over-smoothed the derivative curve. In addition, the pressure derivative obtained using an L value of 0.05 is seen in FIG. 10 to distort the derivative at later times.

Figure 11A:
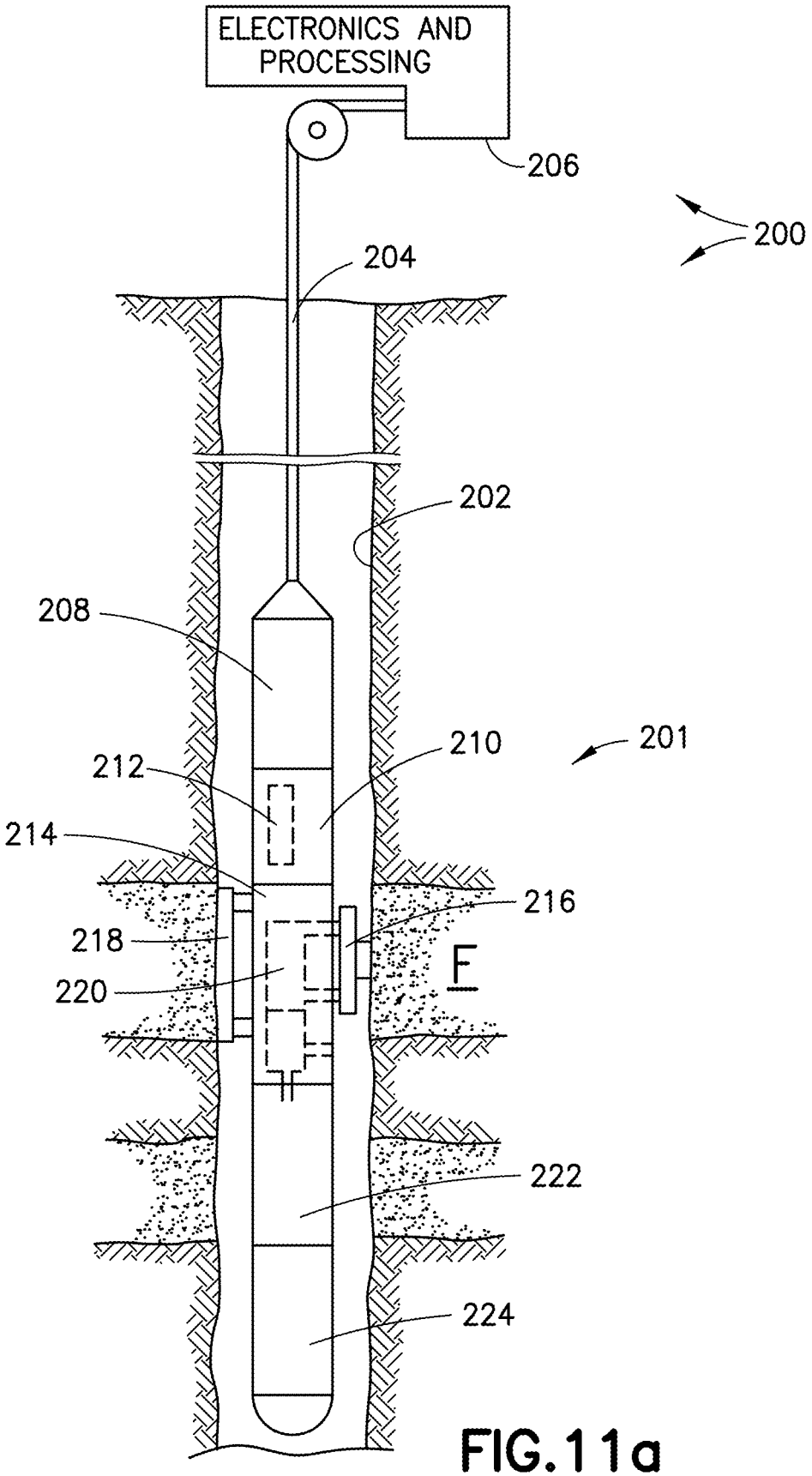
FIG. 11*a* is a diagram of a system including a formation-fluid-sampling borehole tool with the system conducting a flow regime identification using a pressure derivative analysis having a changing optimized window length for pressure data obtained from a formation-fluid-sampling borehole tool.
Figure 11B:
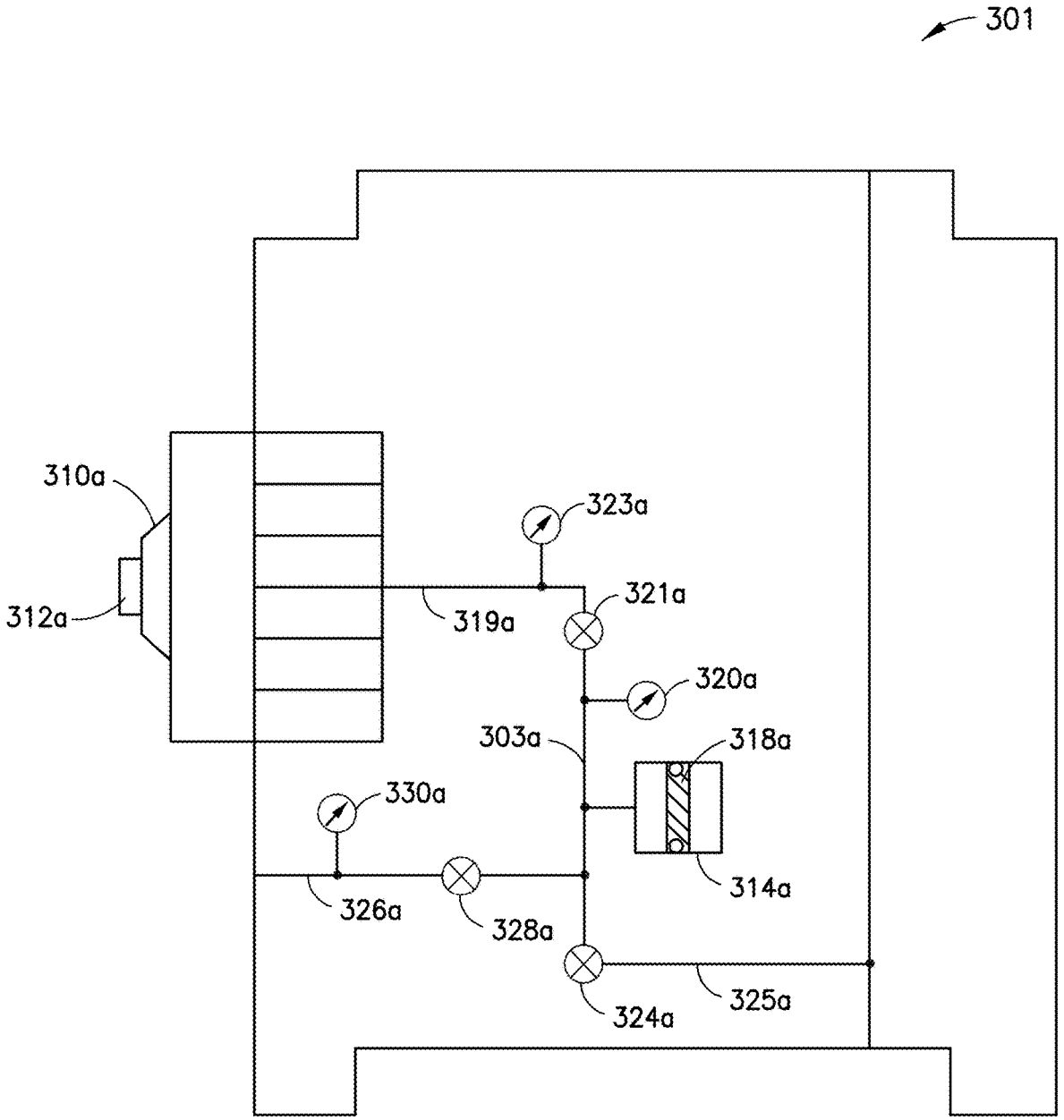
FIG. 11*b* is a schematic of a probe module for use with the formation-fluid-sampling tool of FIG. 11*a*.

Turning now to FIGS. 11*a* and 11*b*, a system 200 is seen for conducting a flow regime identification determination. The system 200 includes a formation-fluid-sampling borehole tool 201 used to measure formation pressure and, optionally, to extract and analyze formation fluid samples. The tool 201 is shown suspended in a borehole or wellbore 202 from the lower end of a multiconductor cable 204 that is spooled on a winch (not shown) at the surface. At the surface, the cable 204 is communicatively coupled to an electrical control and data acquisition system 206 which may include a processor for processing information. The tool 201 has an elongated body 208 that includes a housing 210 having a tool control system 212 configured to control extraction of formation fluid from a formation F and measurements performed on the extracted fluid, in particular, pressure. The wireline tool 201 also includes a formation tester 214 having a selectively extendable fluid admitting assembly 216 and a selectively extendable tool anchoring member 218, which in FIG. 11*a* are shown as arranged on opposite sides of the body 208. The fluid admitting assembly 216 is configured to selectively seal off or isolate selected portions of the wall of the wellbore 202 to fluidly couple to the adjacent formation F and draw fluid from the formation F. The formation tester 214 also includes a fluid analysis module 220 that contains at least one pressure measurement device, which is in pressure communication with the fluid entering the fluid admitting assembly 216 through which the obtained fluid flows. Once the test sequence has been completed the fluid entering the fluid admitting assembly may thereafter be expelled through a port (not shown) or it may be sent to one or more fluid collecting chambers 222 and 224, which may receive and retain the formation fluid for subsequent testing at the surface or a testing facility.

In the illustrated example, the electrical control and data acquisition system 206 and/or the downhole control system 212 are configured to control the fluid admitting assembly 216 to draw fluid samples from the formation F and to control the fluid analysis module 220 to perform measurements on the fluid. In some example implementations, the fluid analysis module 220 may be configured to analyze the measurement data of the fluid samples as described herein. In other example implementations, the fluid analysis module 220 may be configured to generate and store the measurement data and subsequently communicate the measurement data to the surface for analysis at the surface. Although the downhole control system 212 is shown as being implemented separate from the formation tester 214, in some example implementations, the downhole control system 212 may be implemented in the formation tester 214.

The methods described herein may be practiced with any formation tester known in the art, such as the testers described with respect to FIG. 11*a*. Other formation testers may also be used and/or adapted for one or more aspects of the present disclosure, such as the wireline formation tester of U.S. Pat. Nos. 4,860,581 and 4,936,139, the downhole drilling tool of U.S. Pat. No. 6,230,557 and/or U.S. Pat. No. 7,114,562, the entire contents of all of which are hereby incorporated by reference herein.

A version of a fluid communication device or probe module 301 usable with such formation testers is depicted in FIG. 11*b* and is part of system 200. The module 301 includes a probe 312*a*, a packer 310*a* surrounding the probe 312*a*, and a flow line 319*a* extending from the probe 312*a* into the module 301. The flow line 319*a* extends from the probe 312*a* to a probe isolation valve 321*a*, and has a pressure gauge 323*a*. A second flow line 303*a* extends from the probe isolation valve 321*a* to sample line isolation valve 324*a* and an equalization valve 328*a*, and has pressure gauge 320*a*. A reversible pretest piston 318*a* in a pretest chamber 314*a* also extends from the flow line 303*a*. Exit line 326*a* extends from equalization valve 328*a* and out to the wellbore and has a pressure gauge 330*a*. Sample flow line 325*a* extends from sample line isolation valve 324*a* and through the tool. Fluid sampled in the flow line 325*a* may be captured, flushed, or used for other purposes.

The probe isolation valve 321*a* isolates fluid in the flow line 319*a* from fluid in the flow line 303*a*. The sample line isolation valve 324*a* isolates fluid in the flow line 303*a* from fluid in the sample line 325*a*. The equalizing valve 328*a* isolates fluid in a wellbore from fluid in a tool. By manipulating the valves 321*a*, 324*a* and 328*a* to selectively isolate fluid in the flow lines, the pressure gauges 320*a* and 323*a* may be used to determine various pressures. For example, by closing the valve 321*a*, formation pressure may be read by the gauge 323*a* when the probe is in fluid communication with the formation while minimizing the tool volume connected to the formation.

In another example, with the equalizing valve 328*a* open, mud may be withdrawn from the wellbore into the tool by means of the pretest piston 318*a*. Upon closing equalizing valve 328*a*, the probe isolation valve 321*a* and the sample line isolation valve 324*a*, fluid may be trapped within the tool between these valves and the pretest piston 318*a*. The pressure gauge 330*a* may be used to monitor the wellbore fluid pressure continuously throughout the operation of the tool and together with pressure gauges 320*a* and/or 323*a* may be used to measure directly the pressure drop across the mud-cake and to monitor the transmission of wellbore disturbances across the mud-cake for later use in correcting the measured sand-face pressure for these disturbances.

Among other functions, the pretest piston 318*a* may be used to withdraw fluid from or inject fluid into the formation or to compress or expand fluid trapped between the probe isolation valve 321*a*, the sample line isolation valve 324*a* and the equalizing valve 328*a*. The pretest piston 318*a* preferably has the capability of being operated at low rates, for example 0.01 mL/s, and high rates, for example 10 mL/s, and has the capability of being able to withdraw large volumes in a single stroke, for example 100 mL. In addition, if it is necessary to extract more than 100 mL from the formation without retracting the probe 312*a*, the pretest piston 318*a* may be recycled. The position of the pretest piston 318*a* preferably can be continuously monitored and positively controlled and its position can be locked when it is at rest. In some embodiments, the probe 312*a* may further include a filter valve (not shown) and a filter piston (not shown). One skilled in the art would appreciate that while these specifications define one example probe module, other specifications may be used without departing from the scope of the disclosure.

For purposes herein, at least the pressure readings obtained over time by tool 201 are provided to the processor 206 for calculating pressure derivatives utilizing desirable window length values L as previously described.

Once pressure derivatives are calculated utilizing piecewise linear regression with different windows of 2L (having different determined L values) a determination of flow regime may be conducted. In particular, during the pressure buildup in a pretest, the pressure disturbance propagates spherically until one impermeable barrier (a bed boundary) is reached. At this stage, the spherical flow regime is altered and becomes hemispherical. If a second bed boundary is detected later, the flow regime becomes radial. The buildup data can be analyzed to estimate mobilities of the undamaged zone. A first step may be identifying the flow regimes during buildup, utilizing the pressure derivative. In one aspect, because either a spherical flow or a radial flow is likely to be detected during buildup, two pressure derivatives may be computed: one with respect to a spherical time function and one with respect to a radial time function.

Figure 12A:
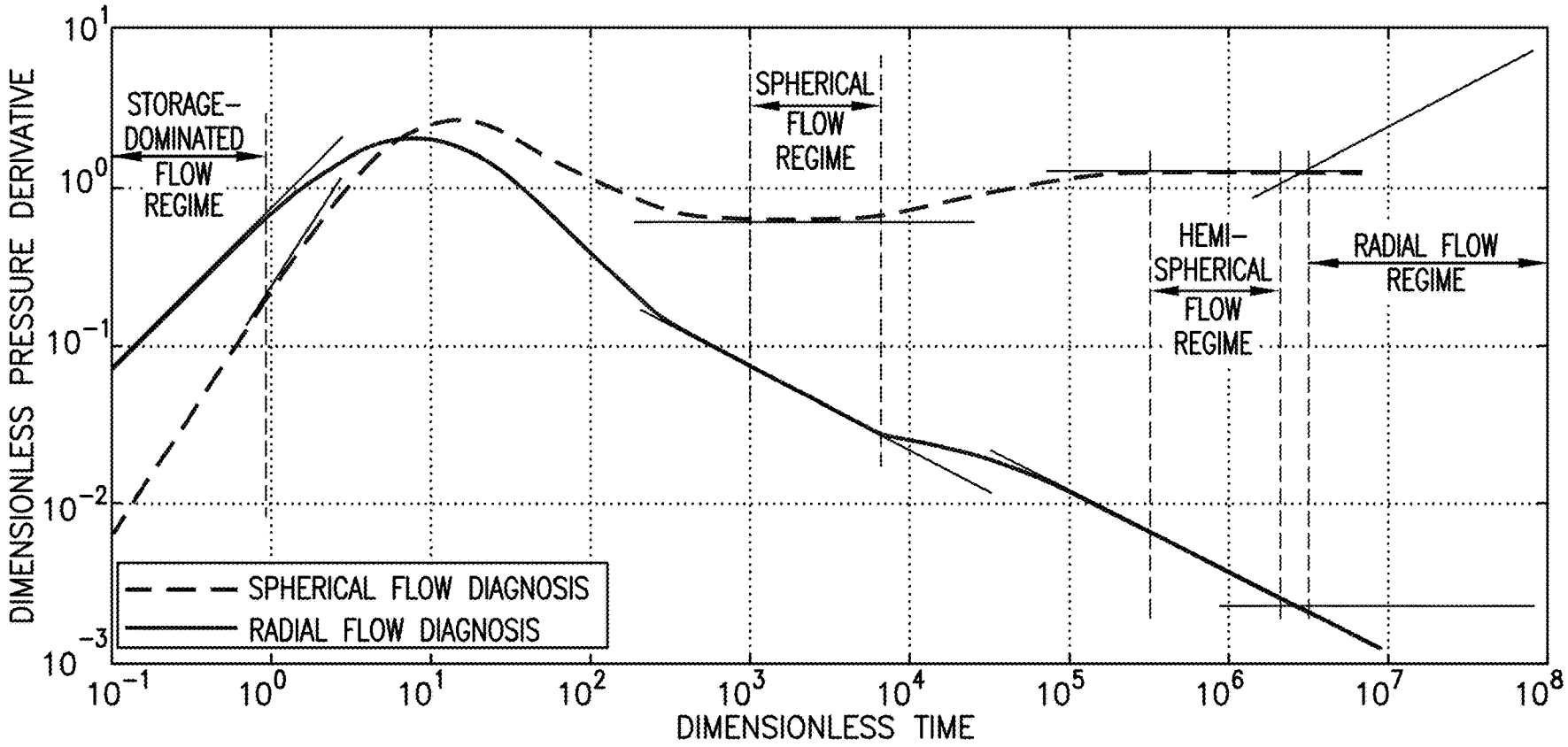
FIGS. 12*a* and 12*b* are examples of plots of pressure derivatives measured as a function of time that are useful for conducting a flow regime determination using the system of FIG. 11*a*.
Figure 12B:
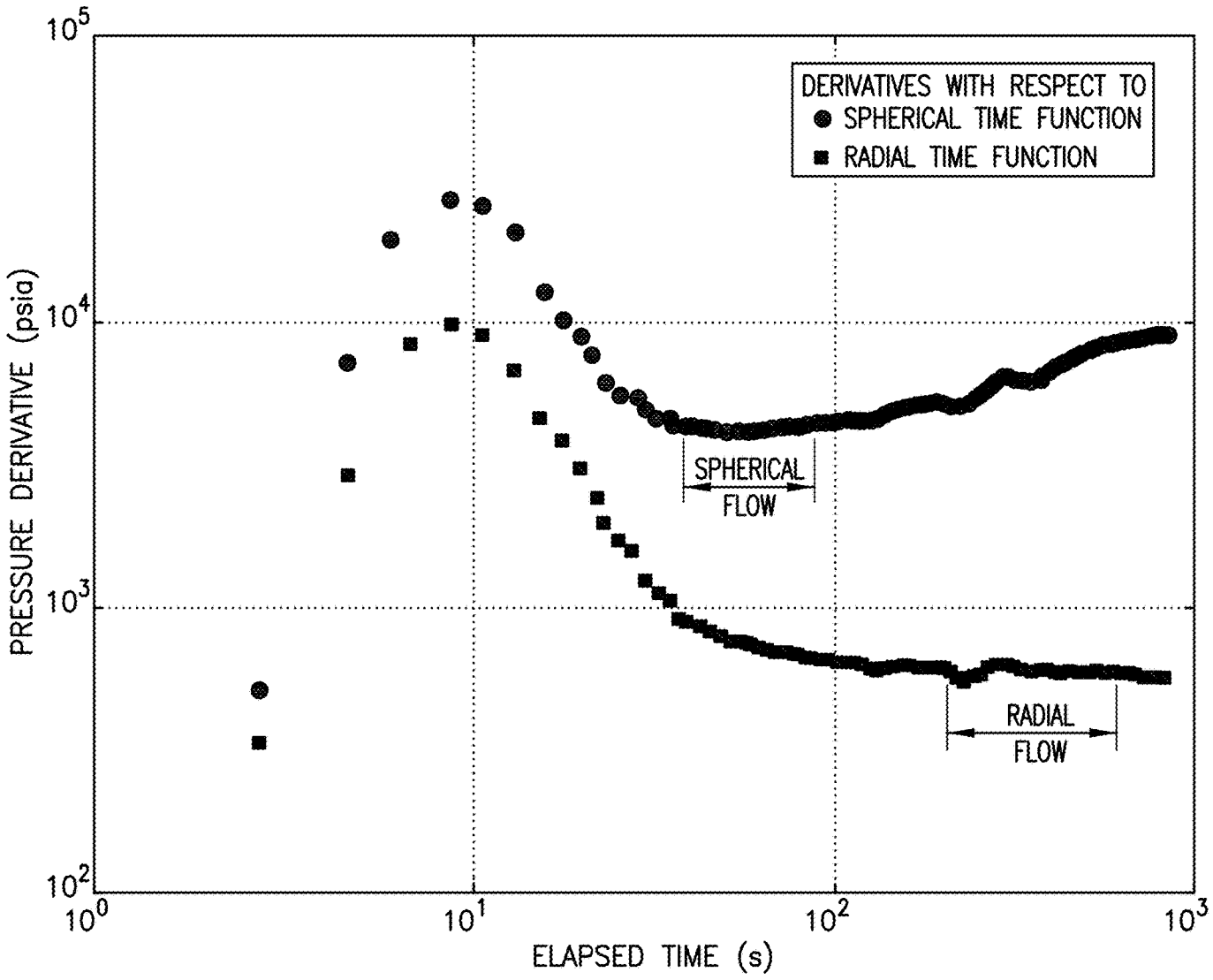

FIG. 12*a* shows the theoretical aspect of the wireline test derivatives for a sink probe buildup while a pretest unfolds. Spherical flow is detected when the spherical derivative (dashed curve) shows a flat horizontal section. During that time period, the radial derivative (solid curve) shows a constant slope equal to −½ on log-log coordinates. Whenever radial flow materializes, the radial derivative shows a horizontal section, and during that time period the spherical flow derivative shows a constant slope equal to +½. Hemispherical flow (one boundary only detected) may also be present. An example of detecting spherical and radial flow using wireline test derivatives such as having been derived using the tool of FIGS. 11*a* and 11*b*, and having generated the pressure derivative curve from said formation fluid pressure data by conducting a piecewise linear regression of the data having a desired/optimal window length values 2L as previously described is seen in FIG. 12*b*. More particularly, and by way of example only, a spherical flow regime is found where the spherical time function pressure derivative is steady and the radial flow pressure derivative is decreasing, and a radial flow regime is found where the radial time function pressure derivative is steady and the spherical time function pressure derivative is increasing.

It will be appreciated that it is within the scope of this disclosure to use other manners of determining flow regime from pressure derivatives calculated from piecewise linear regression with different windows of 2L. By way of example only, a single pressure derivative curve may be analyzed to find flow regime.

Some of the methods and processes described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, or general purpose computer) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

While a limited number of embodiments have been described, those skilled in the art, having benefit of this disclosure, will appreciate that other embodiments can be devised which do not depart from the scope of the invention as disclosed herein. For example, while the disclosure was directed to derivative analysis of pressure buildup at a probe in a borehole, it is equally applicable to derivative analysis of pressure fall-off at the probe. Accordingly, the scope of the invention should be limited only by the attached claims. Moreover, embodiments described herein may be practiced in the absence of any element that is not specifically disclosed herein.

In the claims, means-plus-function clauses, if present, are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A method of investigating an earth formation traversed by a borehole having a wall, comprising:

locating a tool having a probe and a pressure sensor in the borehole;

contacting the borehole wall with the probe and causing fluid movement into or out of the probe;

using the pressure sensor to sense formation fluid pressure data over time;

generating a pressure derivative curve from said formation fluid pressure data by conducting a piecewise linear regression of the data having window length values 2L determined by calculating for selected pressure data points a derivative with respect to L of a pressure derivative value (DD), and selecting a value of L where DD has a transition that departs from oscillatory behavior to gradual change;

using the pressure derivative curve to identify a flow regime of the formation.

2. The method of claim 1, wherein the selecting a value of L where DD has a transition comprises integrating an absolute value of said derivative DD and selecting a location representing a change in slope of the integral from a large value to a small value.

3. The method of claim 2, wherein the selecting a location comprises measuring the slope of the integral.

4. The method of claim 2, wherein the selecting comprises fitting an approximant to the integral where the approximant has a slope that may be analytically estimated at any location.

5. The method of claim 4, wherein the approximant is a Padé approximant.

6. The method of claim 4, wherein the approximant is calculated by a least-square optimization.

7. The method of claim 4, wherein said selecting a location comprises selecting a location where the slope of the approximant when normalized to have equal horizontal and vertical scales is between 0.25 and 0.75.

8. The method of claim 7, wherein the slope of the approximant when normalized is approximately 0.5.

9. The method of claim 4, wherein the selecting comprises removing outlier values prior to said integrating.

10. The method of claim 1, wherein said selected data points are evenly spaced in a log $\Delta t$ domain, where t is the elapsed time since fluid movement is stopped at the probe.

11. The method of claim 10, wherein L is chosen to be a fixed predetermined value for early pressure data points where derivative calculations are not sensitive to noise.

12. The method of claim 1, wherein L is chosen to be a fixed predetermined value for early pressure data points where derivative calculations are not sensitive to noise.

13. A method of providing information about a formation useful for hydrocarbon production, comprising:

locating a tool having a probe and a pressure sensor in a borehole traversing the earth formation;

contacting a wall of the borehole wall with the probe and causing fluid movement into or out of the probe;

using the pressure sensor to sense formation fluid pressure data over time;

generating a pressure derivative curve from said formation fluid pressure data by conducting a piecewise linear regression of the data having window length values 2L determined by calculating for selected pressure data points a derivative with respect to L of a pressure derivative value (DD), and selecting a value of L where DD has a transition that departs from oscillatory behavior to gradual change; and plotting said pressure derivative curve as a function of time.

14. The method of claim 13, wherein the selecting a value of L where DD has a transition comprises integrating an absolute value of said derivative DD and selecting a location representing a change in slope of the integral from a large value to a small value.

15. The method of claim 14, wherein the selecting comprises fitting an approximant to the integral where the approximant has a slope that may be analytically estimated at any location.

16. The method of claim 15, wherein said selecting a location comprises removing outlier values prior to said integrating and selecting a location where the slope of the approximant when normalized to have equal horizontal and vertical scales is between 0.25 and 0.75.

17. The method of claim 13, wherein said selected data points are evenly spaced in a log $\Delta t$ domain, where t is the elapsed time since fluid movement is stopped at the probe.

18. The method of claim 17, wherein L is chosen to be a fixed predetermined value for early pressure data points where derivative calculations are not sensitive to noise.

* * * * *